US007011136B2

(12) United States Patent
Moore et al.

(10) Patent No.: US 7,011,136 B2
(45) Date of Patent: Mar. 14, 2006

(54) METHOD AND APPARATUS FOR MELTING METALS

(75) Inventors: Alan F. Moore, Knoxville, TN (US); Donald E. Schechter, Ten Mile, TN (US); Marvin Stanley Morrow, Marble, NC (US)

(73) Assignee: BWXT Y-12, LLC, Oak Ridge, TN (US)

( * ) Notice: Subject to any disclaimer, the term of this patent is extended or adjusted under 35 U.S.C. 154(b) by 0 days.

(21) Appl. No.: 10/013,029

(22) Filed: Nov. 12, 2001

(65) Prior Publication Data

US 2003/0089481 A1 May 15, 2003

(51) Int. Cl.
*B22D 27/02* (2006.01)
*B22D 41/015* (2006.01)

(52) U.S. Cl. ..... 164/250.1; 164/335; 164/338.1

(58) Field of Classification Search ..... 164/250.1, 164/48, 492, 338.1, 335; 219/678, 686, 756
See application file for complete search history.

(56) References Cited

U.S. PATENT DOCUMENTS 3,732,048 A * 5/1973 Guerga et al. ..... 425/174.4
3,900,947 A * 8/1975 Diepers et al. ..... 29/599
4,147,911 A * 4/1979 Nishitani ..... 219/756
4,330,698 A * 5/1982 Sawada et al. ..... 219/696
4,880,578 A * 11/1989 Holcombe et al. ..... 264/432
4,930,755 A 6/1990 Ekerot et al.
4,940,865 A * 7/1990 Johnson et al. ..... 219/753
5,168,917 A * 12/1992 Okuda et al. ..... 164/495
5,222,543 A * 6/1993 Carlstrom et al. ..... 164/114
5,524,705 A * 6/1996 Matsubara et al. ..... 164/495
5,808,282 A * 9/1998 Apte et al. ..... 219/679
5,941,297 A * 8/1999 Young ..... 164/62
6,143,139 A * 11/2000 Wicks et al. ..... 204/157.43

FOREIGN PATENT DOCUMENTS

JP 59 095381 A 6/1984
WO WO 00/00311 1/2000

OTHER PUBLICATIONS

Non–Certified, Unformatted Translation from Interlingua (Job 10874LUED–Japanese (NC) for JP 59–95381 patent, no date.
International Search, Mar. 2003.
*Melting Metals in a Domestic Microwave* paper by David Reid.

* cited by examiner

*Primary Examiner*—Kevin P. Kerns
(74) *Attorney, Agent, or Firm*—Michael J. Renner; Luedeka, Neely & Graham, P.C.

(57) ABSTRACT

A method and apparatus for melting metals uses microwave energy as the primary source of heat. The metal or mixture of metals are placed in a ceramic crucible which couples, at least partially, with the microwaves to be used. The crucible is encased in a ceramic casket for insulation and placed within a microwave chamber. The chamber may be evacuated and refilled to exclude oxygen. After melting, the crucible may be removed for pouring or poured within the chamber by dripping or running into a heated mold within the chamber. Apparent coupling of the microwaves with softened or molten metal produces high temperatures with great energy savings.

13 Claims, 1 Drawing Sheet

METHOD AND APPARATUS FOR MELTING METALS

The U.S. Government has rights in this invention pursuant to contract number Feb. 13, 2001 DE-AC05-OOR22800 between the Department of Energy and BWXT Y-12, L.L.C.

FIELD OF THE INVENTION

This invention relates generally to the art of metallurgy and more particularly to the art of melting metals.

BACKGROUND OF THE INVENTION

Metals have conventionally been melted, utilizing large loads and large furnaces for so doing. Current state-of-the-art metal melting furnaces include electric arc furnaces, cupola furnaces, blast furnaces, induction furnaces, and crucible or pot furnaces.

Electric arc furnaces are lined with refractories for containing molten metal. Such refractories slowly decompose and are removed with slag, which floats atop the molten metal. Metal to be melted is charged into the furnace with additives to make recovery of slag easier. Heat is provided with electric arcs from three carbon or graphite electrodes. Such furnaces are commonly used in the steel industry, primarily for scrap metal melting because they may be used in decentralized mini-mills that produce items for local markets instead of larger centralized mills.

Cupola furnaces are the oldest type of furnaces used in foundries. Alternating layers of metal and ferrous alloys, coke, and limestone are fed into the furnace from the top. Limestone is added to react with impurities in the metal and floats atop the melt as it melts to protect the metal from oxidation. Cupola furnaces are typically used for melting cast iron or grey iron.

Blast furnaces are extremely large cylinders lined with refractory brick. Iron ore, coke and limestone are dumped into the top of the blast furnace as preheated air is blown into the bottom. The chemical reactions that occur extract the iron from the ore. Once a blast furnace is started, it will run continuously for 4–10 years with only short stops to perform planned maintenance.

Reverberatory or hearth furnaces are used in batch melting of non-ferrous metals. A reverberatory furnace is a special type of hearth furnace in which the material under treatment is heated indirectly by means of a flame deflected downwardly from the roof. Hearth furnaces are used to produce small quantities of metal, usually for specialty alloys.

Induction furnaces are either "coreless" or "channel" type. Coreless melting furnaces use a refractory envelope to contain the metal. The envelope is surrounded by a copper coil carrying alternating current. Operating on the same basis as a transformer, the metal charge in the furnace works like a single secondary terminal, thereby producing heat through eddy current flow when power is applied to the multi-turn copper primary coil. When the metal melts, the electromagnetic forces also produce a stirring action. In an induction channel furnace, a channel is formed in the refractory through the coil, and thus a channel forms a continuous loop with the metal in the main part of the furnace. The hot metal in the channel circulates in the main body of the metal in the furnace envelope and is replaced by a colder metal. Unlike the coreless induction furnace, a source of primary molten metal is required for a startup of a channel furnace.

A crucible or pot furnace is a melting furnace that uses a ceramic crucible to contain the molten metal. The crucible is heated by electric resistant heating elements or by a natural gas flame. Insulation surrounds the crucible to retain heat. Typically, the entire apparatus can be tipped to pour the molten metal into a mold.

All of the existing furnaces consume more energy to melt metal than what is deemed desirable. Additionally, the prior art devices have many safety risks. Other shortcomings include contamination of the melt from materials of construction of the containment, limitations on melt temperatures and requirements for large facilities requiring significant capital costs.

SUMMARY OF THE INVENTION

It is thus an object of this invention to provide a novel process and apparatus for the melting of metal.

It is a further object of this invention to provide such a process and apparatus which utilizes significantly less energy than that of the prior art.

It is a further yet more particular object of this invention to provide such a process and apparatus which will provide for small batches of molten metals with little or no contamination from the containers.

These as well as other objects are achieved by a process wherein a metal is melted within a crucible by the use of microwave energy. An apparatus provides the microwave chamber for containing such a crucible and waveguides for directing microwave energy to the crucible. Heat melts the metal within the crucible while an insulating casket surrounding the crucible protects the surrounding microwave chamber from the heat of the crucible.

DETAILED DESCRIPTION

In accordance with this invention, it has been found that metals may be efficiently and effectively melted using microwave energy. The use of microwaves permits small batches to be melted, the utilization for small amounts of energy, and the use of crucible materials which do not contaminate metals being melted. This is surprising and contrary to popular belief in that it has always been accepted, as described in U.S. Pat. No. 5,941,297, that metals would damage microwave generators, resulting in overall failure of the mechanisms. This shortcoming is obviated by the process and apparatus of this invention. Various other advantages and features will become apparent from the following description given with reference to the various figures of drawing.

In essence, this invention comprises placing a metal on metal to be melted within a crucible, placing that crucible within a microwave chamber and guiding microwaves to that crucible. The microwaves bring about heating of the crucible and the metal. As both the metal and crucible heat they become more susceptible to the microwave energy and the metal begins to heat more rapidly as heating time and temperatures increase. The efficiency of the microwave application may be enhanced and the cycle time reduced by the utilization of a preheat means, to be further described, so that the crucible and its associated metal are heated to a more receptive temperature for microwave heating prior to the application of microwaves thereto.

Figure 1:
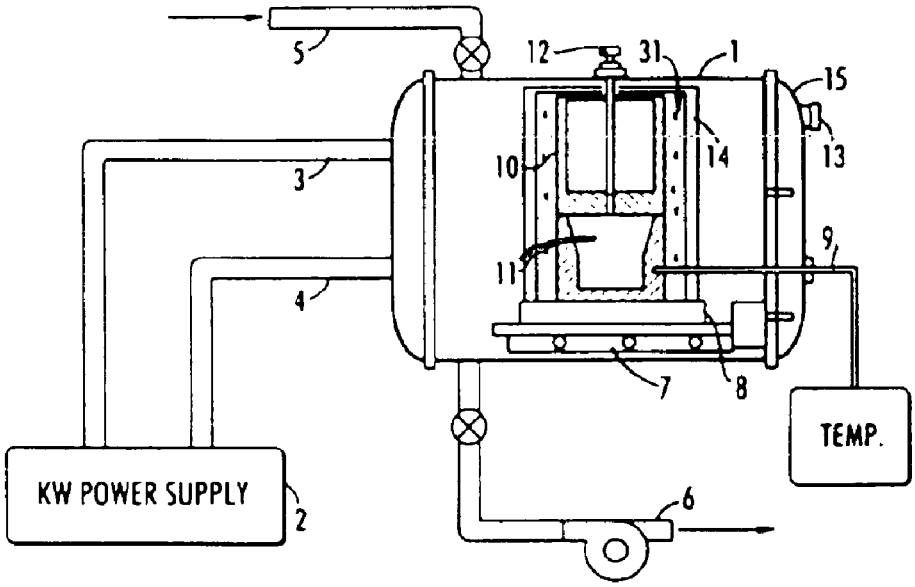
FIG. 1 is a cross-section view illustrating an apparatus in accordance with this invention.

FIG. 1 of the drawings depicts a microwave chamber 1 having microwaves directed thereto from generator 2 through waveguides 3 and/or 4. A vacuum pump 6 may be used to evacuate chamber 1 while a controlled atmosphere such as argon may be admitted through conduit 5.

The metal or metals to be melted is placed within a crucible 10 which, with optional mold 11 and associated ceramic casket insulation 14, can be moved in and out of chamber 1 on a slide table 7 upon an opening and closing of sealed door 15. The ceramic casketing material 14 contains the heat around the crucible 10 and mold 11. An insulation plate 8 beneath the crucible 10 and mold 11 prevents heat loss into and through the slide table and chamber walls. The space 31 between crucible 10 and mold 11 and the casket 14 serves as an insulator and may be empty volume.

Figure 2:
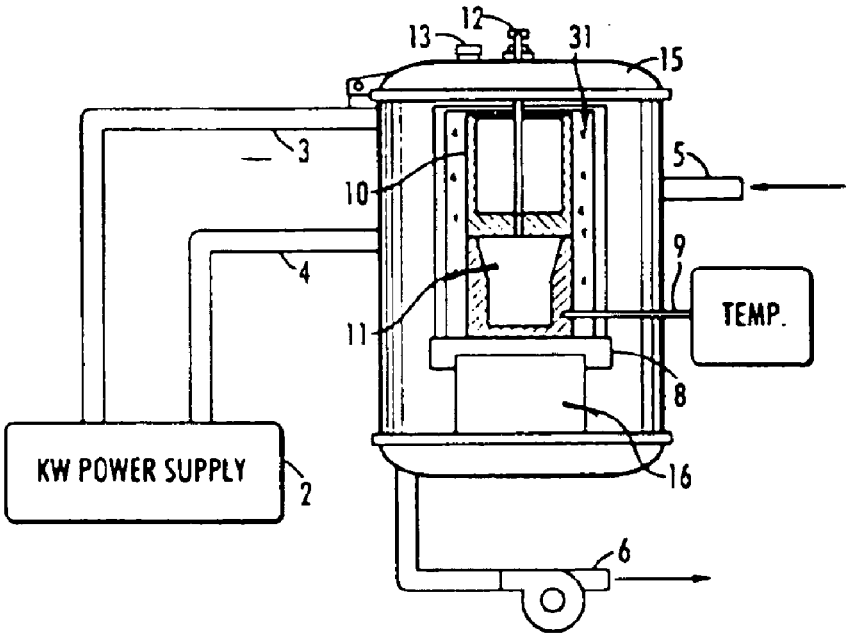
FIG. 2 is a schematic view and cross-section of an alternate embodiment for carrying out the process of this invention.

FIG. 2 illustrates an alternative embodiment opened at the top and having a pedestal 16 to provide greater insulation than available from plate 8 of the first embodiment.

Once the crucible 10 is loaded into the chamber 1 and the chamber sealed, microwave energy is guided into the chamber through waveguides 3 and/or 4. The geometry of the chamber and of the waveguide are configured to focus the microwave energy on the crucible 10 and to uniformly heat crucible 10. The temperature of the crucible 10 can be monitored using a pyrometer such as an optical pyrometer sighted through a sight port 13 in the chamber. As the crucible approaches the melting temperature of the metal, some of the microwave energy couples with the metal itself accelerating the rate of temperature increase. Once the crucible temperature has reached the melting point of the metal in crucible 10 the microwave energy is turned off. At this point the door of the chamber can be opened and the molten metal removed and poured.

A mold 11 may be located in the chamber beneath crucible 10. In this configuration, it is preferred to have a second waveguide 4 to direct microwave energy toward mold 11. Additional waveguides may be added to further control the thermal profile of crucible 10 and mold 11. The use of multiple tuned waveguides reduces or eliminates the need for a stirring motor in the chamber to homogenize the microwave energy within chamber 1. The temperature of mold 11 is monitored such as by a thermocouple 9. Temperatures can be controlled by selectively directing the microwave energy through waveguides 3 and 4. It is preferred to have mold 11 reach the melting temperature of the metal being melted simultaneously, or slightly before, crucible 10 reaches that temperature. Once the metal in the crucible begins to melt, either of two configurations can be used for introducing the molten metal into the mold 1 while optionally irradiating the molten metal with microwave radiation.

Preferably the composition of the crucible and mold includes materials such as carbon, graphite, or silicon carbide that are susceptors of microwave energy. In some embodiments the crucible is formed from a material which is transported to at least a portion of said microwaves.

A simple pass-through hole or drip between crucible 10 and mold 11 permits the molten metal to drip into mold 11 as it melts.

Alternatively, a pour rod 12 may be used to plug the pass-through hole between crucible 10 and mold 11 until it is desired to move a quantity of molten metal into the mold 11. When such movement is desired, the pour rod 12 is raised and the molten metal flows from crucible 10 into mold 11. The pour in this case is more homogeneous and the process more suitable for the molding of alloys.

In numerous experiments it has been demonstrated that melts made in microwave melting furnaces do not crack crucibles. This is due to a more even heating of the crucible than in conventional crucible furnaces using more concentrated heat sources and greater differences in temperature between heat source and crucible. With the microwave melting process, the crucible is heated by direct coupling with the microwaves. This needs to be contrasted with the thermal shock associated with induction heating where the metal is heated by eddy currents. Additionally, through various experiments a variety of ceramics have been used as crucibles and mold materials which have distinct advantages over materials such as graphite typically used in induction heating. Graphite or carbon tends to chemically contaminate metal melts, especially when used repeatedly.

Cycle times for melting and casting has been shown to be comparable to that of induction processes, but with microwave processes requiring significantly less power. High temperatures of approximately 2300° C. can be reached with a relatively low power demand (2–6 kilowatt) using the microwave process of this invention. This can be compared with moderate temperatures of 1400–1800° C. in induction heating wherein 10–150 kilowatts are required.

Alternate embodiments of this invention would include the use of an auxiliary heating source such as a resistance heater (not shown) in insulating space 31 to preheat the crucible 10 and its associated metal load.

The use of a microwave chamber offers other advantages. The metal is melted in a controlled atmosphere which can be essentially free of oxygen. The chamber constitutes a protective barrier between operators and the very hot molten metal. The process may be semi-automated placing multiple molds within the chamber and robotically recharging the crucible.

The pour rod may have additional uses. Rotation of the rod may provide a stirring motion, particularly useful when performing alloying. A micro porous rod (in whole or part) may be used to introduce gas into the chamber and/or sparge the melt.

Two COBRA™ 2.45 GHz microwave generators driven by two 6 kw power supplies, using standard copper wave guides tuned to 2.45 GHz have achieved crucible temperatures in excess of 1650° C. and melted copper, stainless steel, and aluminum. Applying microwave energy for a longer period of time achieves temperatures of 1800° C. and melts gold and platinum. Boron has also been melted at >2000° C.

It is thus seen that the process and apparatus of this invention provide a novel technique for melting of metallic material. It is further seen that such process and apparatus provides for a variety of crucible materials as well as for small loads in the substantial reduction of power and space requirements.

As the above description is exemplary in nature such variations are included within the spirit and scope of this invention as defined by the following appended claims.

We claim:

1. A furnace apparatus for melting metal comprising:

a microwave chamber;

at least one tuned microwave generator and a power supply for generating microwave energy within the microwave chamber;

a one-piece crucible disposed in the microwave chamber and formed from a composition of material that is configured and composed to hold both solid and molten metal and that is refractory to a molten metal and that includes susceptors of microwaves, said one-piece crucible comprising a single stratum that partially absorbs and partially transmits the microwave energy;

metal disposed in the one-piece crucible, the metal being disposed for (1) absorbing heat from the one-piece crucible when the metal is in a solid state and is not coupled to the microwave energy and (2) absorbing heat from the one-piece crucible and absorbing energy from the microwaves to produce heat when the metal is heated by the one-piece crucible to a temperature at which the metal will couple to the microwave energy;

a thermal insulation casket enclosing the one-piece crucible, where the casket is formed from a material that does not couple substantially with microwave energy; and the one-piece crucible being composed and configured to absorb microwaves, generate heat due to the absorption of microwaves, and transfer heat to the metal at least until the one-piece crucible temperature approaches the melting temperature of the metal, the one-piece crucible being further composed to transmit microwaves through the one-piece crucible such that some of the microwave energy couples with the metal when the metal approaches its melting temperature and accelerates the rate of temperature increase of the metal to thereby melt the metal within the one-piece crucible.

2. The apparatus of claim 1 further comprising:

a means other than a microwave generator for heating the one-piece crucible.

3. The apparatus of claim 2 wherein:

the means other than a microwave generator for heating the one-piece crucible comprises a resistance heater.

4. The apparatus of claim 1 further comprising:

a means for evacuating the microwave chamber.

5. The apparatus of claim 1 further comprising:

a means for establishing a controlled atmosphere in the microwave chamber.

6. The apparatus of claim 1 wherein the one-piece crucible is formed from a composition of material that is configured and composed to hold substantially only solid and molten metal.

7. An apparatus for casting metal comprising:

a microwave chamber;

at least one tuned microwave generator and a power supply for generating microwave energy within the microwave chamber;

a one-piece crucible disposed in the microwave chamber and formed from a composition of material that is configured and composed to hold both solid and molten metal and that is refractory to a molten metal and that includes susceptors of microwaves, said one-piece crucible comprising a single stratum that partially absorbs and partially transmits the microwave energy;

metal disposed in the one-piece crucible, the metal being disposed for (1) absorbing heat from the one-piece crucible when the metal is in a solid state and is not coupled to the microwave energy and (2) absorbing heat from the one-piece crucible and absorbing energy from the microwaves to produce heat when the metal is heated by the one-piece crucible to a temperature at which the metal will couple to the microwave energy;

a thermal insulation casket enclosing the one-piece crucible, where the casket is formed from a material that does not couple substantially with microwave energy;

the one-piece crucible being composed and configured to absorb microwaves, generate heat due to the absorption of microwaves, and transfer heat to the metal at least until the one-piece crucible temperature approaches the melting temperature of the metal, the one-piece crucible being further composed to transmit microwaves through the one-piece crucible such that some of the microwave energy couples with the metal when the metal approaches its melting temperature and accelerates the rate of temperature increase of the metal to thereby melt the metal within the one-piece crucible, the one-piece crucible being further configured with a pass-through hole in its bottom; and a mold disposed beneath the one-piece crucible for receiving molten metal from the pass-through hole.

8. The apparatus of claim 7 further comprising:

a means other than a microwave generator that is disposed to heat the mold.

9. The apparatus of claim 8 wherein:

the means other than a microwave generator that is disposed to heat the mold comprises a resistance heater.

10. The apparatus of claim 7 further comprising:

a pour rod removably inserted into the pass-through hole in the one-piece crucible.

11. The apparatus of claim 10 wherein:

the pour rod is micro-porous at least in part and incorporates a means for introducing gas into the microwave chamber.

12. The apparatus of claim 10 wherein:

the pour rod is micro-porous at least in part and incorporates a means for introducing gas to sparge the melt.

13. The apparatus of claim 7 wherein the one-piece crucible is formed from a composition of material that is configured and composed to hold substantially only solid and molten metal.

* * * * *